US005399132A

United States Patent [19]

Bailey

[11] Patent Number: 5,399,132

[45] Date of Patent: Mar. 21, 1995

[54] SAFETY ENCLOSURE FOR TRAMPOLINE

[76] Inventor: Arthur Bailey, 30730 Duff Rd., Walker, La. 70785

[21] Appl. No.: 123,053

[22] Filed: Sep. 20, 1993

[51] Int. Cl.[6] ..... A63B 5/11

[52] U.S. Cl. ..... 482/29; 482/27; 160/135

[58] Field of Search ..... 482/27, 28, 29, 24, 482/35, 36; 256/45, 46; 160/135; 52/239; 5/99.1, 100

[56] References Cited

U.S. PATENT DOCUMENTS

| | | | |
|---|---|---|---|
| 2,464,866 | 3/1949 | Holtz | 5/99.1 |
| 2,491,966 | 12/1949 | Gans | 5/99.1 |
| 2,895,717 | 7/1959 | De Falco | 160/135 |
| 4,078,795 | 3/1978 | Porter . | |
| 4,433,838 | 2/1984 | Gordon . | |
| 4,623,126 | 11/1986 | Pettit . | |
| 4,900,011 | 2/1990 | Nolet . | |
| 5,102,103 | 4/1992 | Putnam . | |

FOREIGN PATENT DOCUMENTS

| | | | |
|---|---|---|---|
| 2623719 | 6/1989 | France | 482/27 |

*Primary Examiner*—Richard J. Apley

*Assistant Examiner*—Lynne A. Reichard

*Attorney, Agent, or Firm*—David L. Ray

[57] ABSTRACT

An enclosure apparatus for preventing injury to a person using a trampoline of the type having a plurality of spaced apart vertical legs supporting a horizontally disposed frame surrounding a bed, the enclosure apparatus including a plurality of panel assemblies, each of the panel assemblies including an elongated horizontal member having a first end and a second end, two elongated vertical members having a top end and a bottom end, the top end of one on the two vertical members being connected to the first end of the elongated horizontal member and the top end of the other of the two vertical members being connected to the second end of the horizontal member, a plurality of vertical ropes connected to the elongated horizontal members and to the frame, a plurality of horizontal ropes connected to the elongated vertical members, opening means in one of the panel assemblies for permitting a user of the trampoline to enter the enclosure apparatus, the plurality of panel assemblies being connected to the frame adjacent to each other completely around the frame, the panel assemblies extending upward from the frame.

21 Claims, 3 Drawing Sheets

SAFETY ENCLOSURE FOR TRAMPOLINE

BACKGROUND OF THE INVENTION

1. Field of the Invention

The invention relates to enclosures, and more particularly, to enclosures for recreational areas. Most particularly, the present invention is related to an enclosure for protecting the occupants of an enclosed recreational area from injury.

2. Description of the Related Art

Enclosures are well known in the art, as are enclosures for recreational areas. Exemplary of the prior art enclosures are the following patents:

U.S. Pat. No. 3,501,141 discloses a trampoline and backstops which is a single trampoline fitted with an inclined backstop adjacent each end of its bed. Each backstop includes an inverted U-shaped frame within which is disposed a backstop panel resiliently attached to and stretched between the margins of the backstop frame. Each backstop panel is positioned and sufficiently strong and resilient to rebound a performer back onto the trampoline bed as well as to permit him to run thereup. Additionally a piece of material is provided for closing the gap between the lower ends of the backstop panels and the trampoline bed formed when the latter is deflected downwardly.

U.S. Pat. No. 4,078,795 discloses a tension cable enclosure with barriers hung from tension cables that are suspended from corner supports, each of which includes a pair of compression members and a tensile member. The compression members of each pair are disposed obliquely with respect to their associated tensile member which is disposed vertically, and the compression members and tensile member of each comer support converge at an apex from which the tension cable is suspended. One compression member of each corner support lies in a plane that is parallel to one side of the enclosure and the other compression members of that corner support lie in a plane that is parallel to an adjacent side of the enclosure, the associated tensile member being at the intersection of the two planes.

U.S. Pat. No. 4,433,838 discloses an exercise structure for use as an exercise compartment and a method for playing a ball game therein. The structure has a horizontal rebound surface which is supported above the ground and has a device for enclosing the air space above the surface to form a cell, the cell being of a size suitable for enclosing at least one human using the surface as a springboard for exercise or for playing the ball game.

U.S. Pat. No. 4,623,126 discloses a perimeter fence for above-ground swimming pools. The perimeter fence includes a plurality of three different assemblies which are fence post assemblies (18), rail assemblies (20) and mounting assemblies which include bottom post connectors (22) and top post connectors (24). The angles of the posts can be varied relative to the pools to accommodate for differing overhangs of top rails (14), and the rail assemblies are field cut to accommodate for differing spacings between the pool wall supports (12) as well as differing angles. Each of the post assemblies (18) include rail connectors (30) which have outwardly extending tubular portions (36), the inner and outer faces (80, 76) being at differing angles to provide for differing diameter pools.

U.S. Pat. No. 4,900,011 discloses an exerciser and playpen structure having a trampoline like bottom which provides a new and useful playpen and exercise structure for an infant or small child. The structure includes a lower frame section having a resilient surface supported therein, an upper frame section, a series of support members depending from the lower frame section for supporting the upper frame section, and a curtain secured continuously at the top to the upper frame section and at the bottom to the resilient surface.

U.S. Pat. No. 5,102,103 discloses a child safety fence which prevents unsupervised children from entering swimming polls includes a plurality of spaced apart substantially vertical supports having a flexible line extending between and slidably supported by the supports. A flexible netting is attached to the flexible line and extends between the supports. A flexible line is connected to an audible alarm signal so that weight on the netting or the flexible line causes activation of the alarm signal.

SUMMARY OF THE INVENTION

In accordance with the present invention there is provided an enclosure apparatus and method for preventing injury to a person using a trampoline of the type having a plurality of spaced apart vertical legs supporting a horizontally disposed frame surrounding a bed, the enclosure apparatus including a plurality of panel assemblies, each of the panel assemblies including an elongated horizontal member having a first end and a second end, two elongated vertical members having a top end and a bottom end, the top end of one on the two vertical members being connected to the first end of the elongated horizontal member and the top end of the other of the two vertical members being connected to the second end of the horizontal member, a plurality of vertical ropes connected to the elongated horizontal members and to the frame, a plurality of horizontal ropes connected to the elongated vertical members, opening means in one of the panel assemblies for permitting a user of the trampoline to enter the enclosure apparatus, the plurality of panel assemblies being connected to the frame adjacent to each other completely around the frame, the panel assemblies extending upward from the frame.

The present invention has the advantage of reducing and preventing injuries to trampoline users by reducing the probability of the user striking the horizontally disposed frame while jumping on the trampoline.

The invention has the further advantage of being low in cost and easily installed on typical trampolines.

BRIEF DESCRIPTION OF THE PREFERRED EMBODIMENTS

Figure 1:
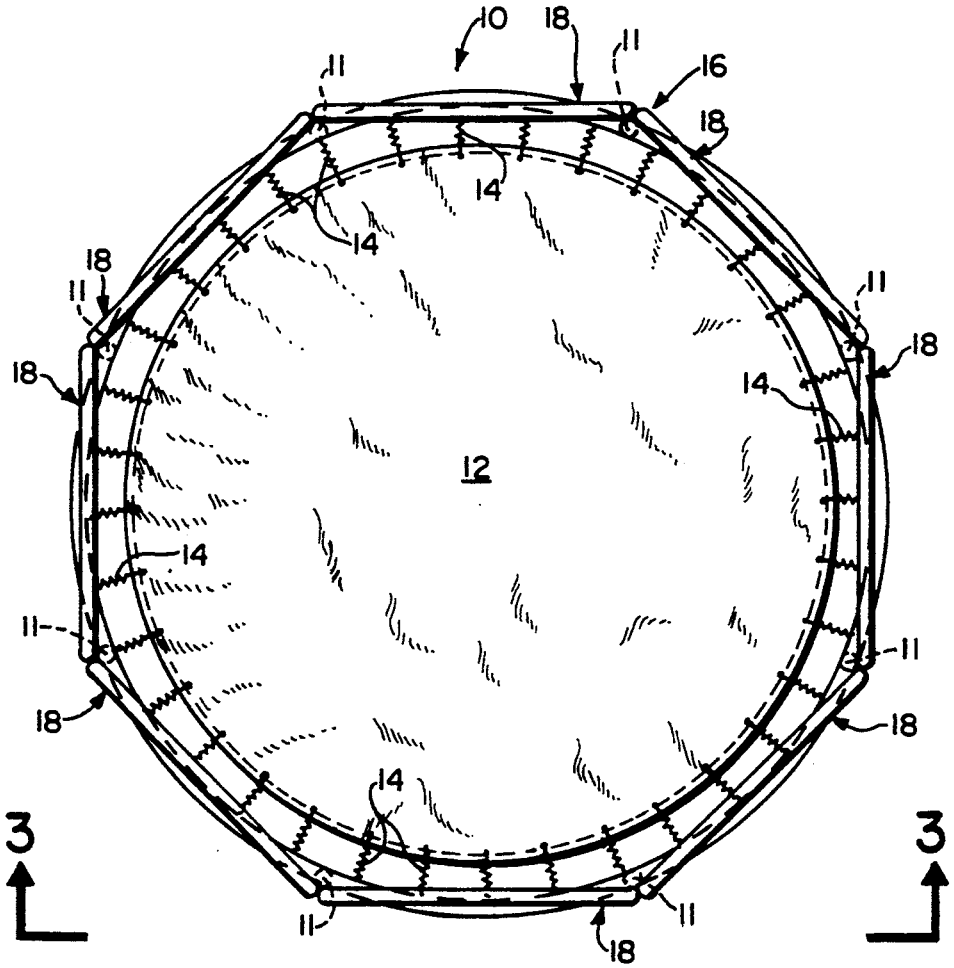
FIG. 1 is a top view of a typical trampoline having the apparatus of the invention connected thereto.
Figure 3:
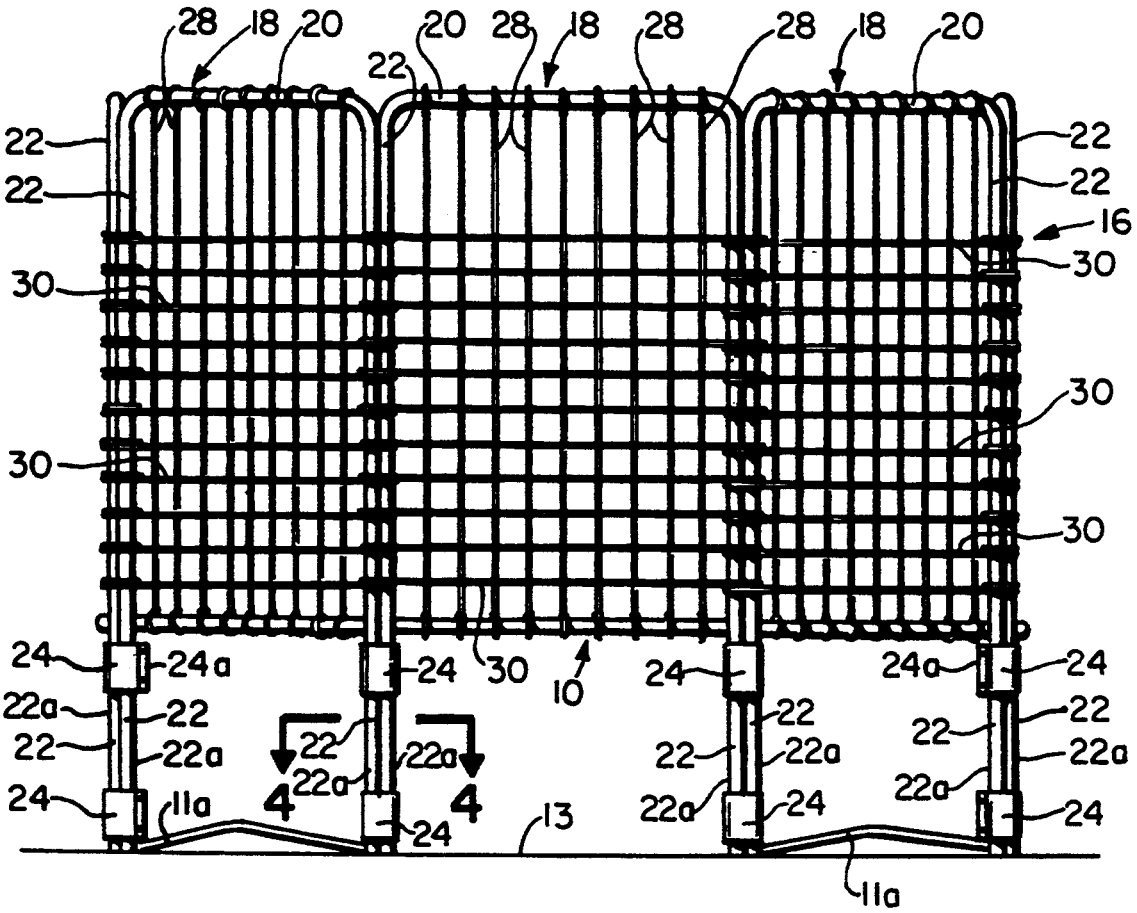
FIG. 3 is a side view of the invention taken along lines 3—3 of FIG. 1.
Figure 5:
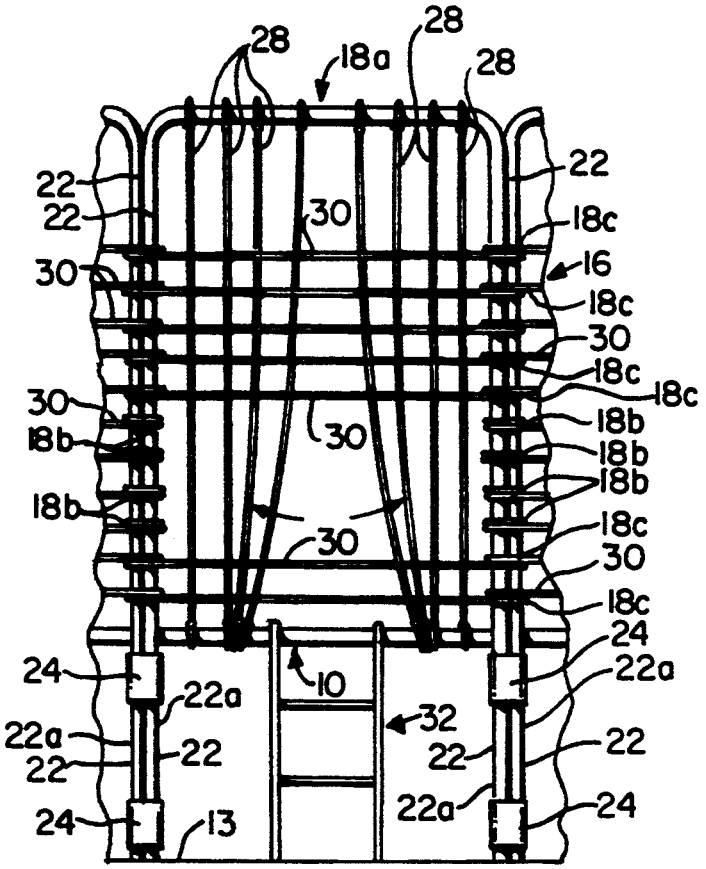
FIG. 5 is a side view of the entrance portion to the trampoline.

Referring now to the drawings, and in particular to FIGS. 1, 3, and 5, a typical, conventional trampoline is shown to include a horizontally disposed rectangular frame 10 surrounding the trampoline bed 12. Frame 10 is supported by a plurality of vertical legs 11 which are rigidly connected to frame 10 in any conventional manner known in the art and elevate the trampoline bed 12 above the surface 13 upon which the legs 11 rest. Legs 11 may be connected to spacer members 11a to provide additional lateral support for the bottom of legs 11. Frame 10 is preferably made of metal, but could be made of any rigid material sufficiently strong enough to support trampoline bed 12.

Trampoline bed 12 is a conventional trampoline bed made from a suitable woven or non-woven material. Supporting bed 12 within frame 10 are a plurality of laterally spaced, resilient elastic support members 14, which may be coil springs, rubber cables or the like, suitably connected at their outer ends to frame 10 and at their inner ends to the margins of bed 12 in any manner well known in the art such as that described in U.S. Pat. No. 3,501,141, which is hereby incorporated by reference.

The enclosure apparatus of the present invention is generally indicated by the numeral 16. Enclosure apparatus 16 can be adapted to a wide variety of different trampoline designs. The trampoline could be of various shapes such as rectangular, square, oval-shaped, and the like.

Enclosure apparatus 16 includes a plurality of generally rectangular panel assemblies generally indicated by the numeral 18. Panel assemblies 18 are generally U-shaped and include a horizontal member 20 which is rigidly connected to two vertical members 22. The members 20 and 22 may be made from any conventional rigid material such as plastics or metal. Preferably the members 20 and 22 are made from polyvinyl chloride pipe.

Figure 2:
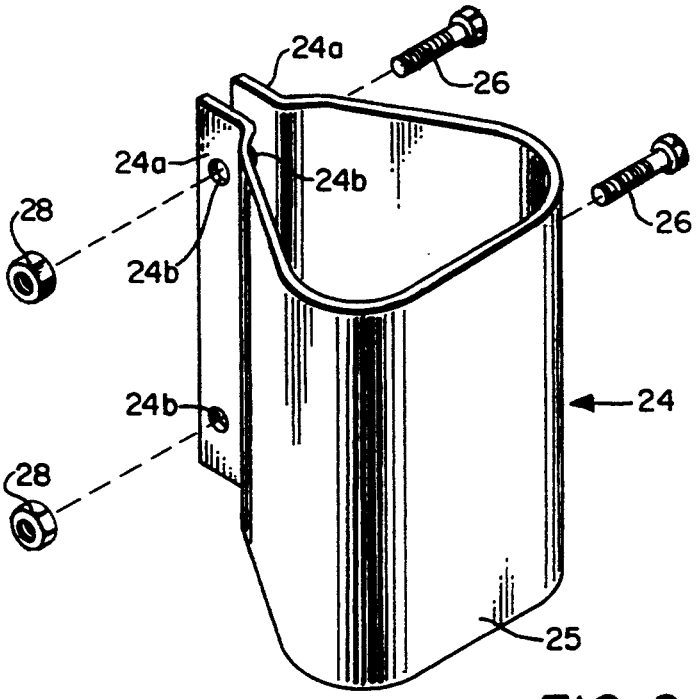
FIG. 2 is an exploded, perspective view of a fastener utilized in the present invention.
Figure 4:
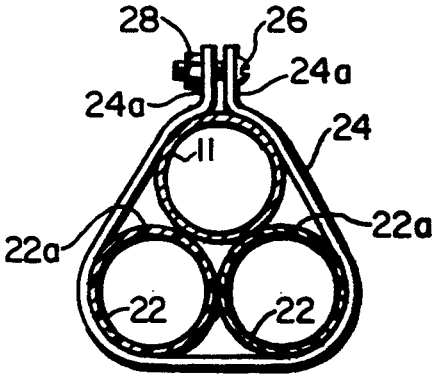
FIG. 4 is a partly cross-sectional view taken along lines 4—4 of FIG. 3.

The lower ends **22*a* of vertical members 22 of panel assemblies 18 are connected to legs 11 and to the vertical members of an adjacent panel assembly 18 by a plurality of rigid clamps 24 as shown FIG. 3 and FIG. 5, and shown in an enlarged top view in FIG. 4. An enlarged perspective view of a clamp 24 is shown in FIG. 2**.

As can be seen in the drawings, damps 24 have an elongated body 25 and generally triangular cross-section of sufficient size to receive two vertical members 22 and one vertical leg 11. The clamps 24 are made of a rigid material such as metal and have two flanges **24*a*. Flanges 24*a* have holes 24*b* for receipt of fasteners such as bolts 26 and nuts 28 to force clamps 24 tightly about two vertical members 22 and one vertical leg 11**.

A plurality of parallel vertical ropes or straps 28 are connected at one end horizontal members 20 and at the other end to frame 10. The vertical ropes 28 are spaced apart a distance sufficient to prevent a user from falling between the vertical ropes 28, and preferably the distances between each adjacent parallel vertical rope 28, and each vertical member 22 and the adjacent parallel vertical rope 28, are equal, i.e., the vertical ropes 28 are spaced apart equidistantly as shown in FIG. 3.

Figure 6:
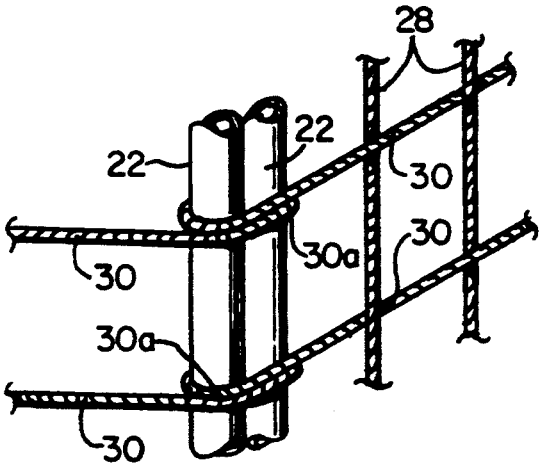
FIG. 6 is a detailed perspective view of the horizontal ropes connecting the vertical supports and of the vertical ropes woven therebetween which form a net or web.

A plurality of parallel horizontal ropes or straps 30 are connected to vertical members 22. Horizontal ropes 30 are .interwoven with vertical ropes 22 and are spaced apart a distance sufficient to prevent a user from falling between or through the vertical ropes 28 or horizontal ropes 30. Preferably the distances between each adjacent parallel horizontal rope 30, and frame 10 and the adjacent parallel horizontal member 30, are equal, i.e., the horizontal ropes 30 are spaced apart equidistantly as shown in FIG. 3. The horizontal ropes 30 are preferably woven between successive vertical ropes 28 as shown in FIG. 6 to form a net or web, the intersection of adjacent vertical and horizontal ropes preferably defining a plurality of square openings in the net as can be seen in FIG. 3. Preferably horizontal ropes 30 are wrapped once around the adjacent vertical members 22 of panel assembly 18 as shown in FIG. 6 at **30*a*, and the two ends of the horizontal ropes 30 are tied together in any conventional manner at one pair of adjacent vertical members 22. Thus when the user should strike or impact upon vertical ropes 28 and horizontal ropes 30, the force of the impact will be distributed over the entire array of panel assemblies 18**.

In FIG. 5 is shown the entrance panel **18*a*to the trampoline. Any one of the panel assemblies 18 may be selected as the entrance panel 18*a*. The entrance panel 18*a*has horizontal members 20 and vertical members 22 which are identical to the other panel assemblies 18. The entrance panel assembly 18*a*has the vertical ropes 28 in the center of the panel displaced to each side of the center to permit the user to enter the enclosure 16 and utilize the trampoline. A ladder generally indicated by the numeral 32 may be connected to frame 10 as shown in FIG. 5, or the ladder 10 may be omitted if desired. Furthermore, a plurality of horizontal ropes 30 on the lower portion of the panel assembly 18*a*are tied at 18*b* to create an opening in panel assembly to permit the user to enter the enclosure 16. The ends of remainder of the horizontal ropes which extend completely around the enclosure can be tied together at one of the pair of adjacent vertical members 22 at panel assembly 18*a*as shown at 18*c*or at one of the two pairs of adjacent vertical members 22** of any other of the panel assemblies.

Figure 7:
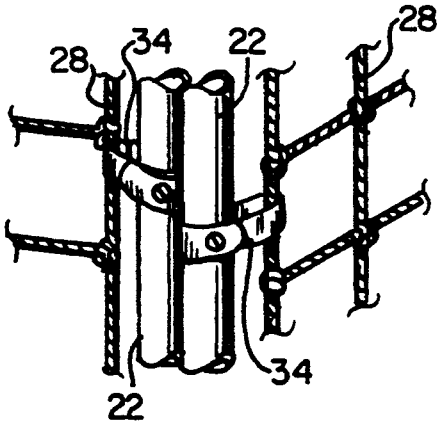
FIG. 7 is a detailed perspective view of an alternate manner of connecting rope webbing or net to the vertical supports.

An alternate manner, though not preferred, of connecting horizontal ropes 30 to vertical members 22 of panel assemblies 18 is shown in FIG. 7. As can be seen in FIG. 7, the horizontal ropes 28 immediately adjacent to vertical members 22 are connected to vertical members 22 by bands or brackets 34.

If desired, the panel assemblies 18 and **18*a*can be aligned at a slight angle away from the vertical centerline of trampoline bed 12** to aid in reducing the impact of the user striking the enclosure.

Although the preferred embodiments of the invention have been described in detail above, it should be understood that the invention is in no sense limited thereby, and its scope is to be determined by that of the following claims:

What is claimed is:

1. In a trampoline of the type having a plurality of spaced apart vertical legs supporting a horizontally disposed frame surrounding a bed, the improvement comprising an enclosure apparatus for preventing injury to a person using said trampoline, said enclosure apparatus comprising:

a. a plurality of panel assemblies connected to said frame adjacent to each other completely around the length of said frame, said panel assemblies extending upward from said frame, each of said panel assemblies including i. an elongated horizontal member having a first end and a second end, ii. two elongated vertical members having a top end and a bottom end, said top end of one on the two vertical members being connected to said first end of said elongated horizontal member and said top end of the other of said two vertical members being connected to said second end of said horizontal member, b. a plurality of vertical ropes connected to said elongated horizontal members and to said frame, c. a plurality of horizontal ropes connected to said elongated vertical members, and d. opening means in one of said panel assemblies for permitting a user of said trampoline to enter said enclosure apparatus, said opening means comprising an opening in said horizontal ropes and said vertical ropes formed by spacing two of said horizontal ropes which are adjacent and two of said vertical ropes which are adjacent apart a distance sufficient to permit the user to enter said enclosure apparatus through said opening in said vertical and said horizontal ropes.

2. The apparatus of claim 1 wherein said panel assembly is U-shaped.

3. The apparatus of claim 1 wherein each of said vertical members are connected to one of said plurality of vertical legs.

4. The apparatus of claim 3 wherein said vertical members are connected to said vertical legs by clamp means for forcing said vertical members into parallel contact with said vertical legs.

5. The apparatus of claim 4 wherein said clamp means has an elongated body and is generally triangular in cross-section.

6. The apparatus of claim 1 wherein each of said panel assemblies is connected to an adjacent panel assembly by said horizontal ropes.

7. The apparatus of claim 1 wherein said plurality of vertical ropes are spaced equidistantly apart.

8. The apparatus of claim 1 wherein said plurality of horizontal ropes are spaced equidistantly apart.

9. In a trampoline of the type having a plurality of spaced apart vertical legs supporting a horizontally disposed frame surrounding a bed, the improvement comprising an enclosure apparatus for preventing injury to a person using said trampoline, said enclosure apparatus comprising:

a. a plurality of panel assemblies connected to said frame adjacent to each other completely around the length of said frame, said panel assemblies extending upward from said frame, each of said panel assemblies including i. an elongated horizontal member having a first end and a second end, ii. two elongated vertical members having a top end and a bottom end, said top end of one on the two vertical members being connected to said first end of said elongated horizontal member and said top end of the other of said two vertical members being connected to said second end of said horizontal member, b. a plurality of vertical ropes connected to said elongated horizontal members and to said frame, c. a plurality of horizontal ropes connected to said elongated vertical members, each of said panel assemblies being connected to an adjacent panel assembly by wrapping said horizontal ropes once around a pair of said adjacent elongated vertical members and tying the two ends of said horizontal ropes at one pair of said adjacent elongated vertical members for distributing the force of any impact upon said horizontal and vertical ropes over all of said plurality of panel assemblies, d. opening means in one of said panel assemblies for permitting a user of said trampoline to enter said enclosure apparatus

10. The apparatus of claim 9 wherein said opening means comprises an opening in said horizontal ropes and said vertical ropes formed by spacing two of said horizontal ropes which are adjacent and two of said vertical ropes which are adjacent apart a distance sufficient to permit the user to enter said enclosure apparatus through said opening in said vertical and said horizontal ropes.

11. The apparatus of claim 9 wherein said vertical members are connected to said vertical legs by clamp means for forcing said vertical members into parallel contact with said vertical legs.

12. The apparatus of claim 11 wherein said clamp means has an elongated body and is generally triangular in cross-section.

13. The apparatus of claim 9 wherein each of said panel assemblies is connected to an adjacent panel assembly by said horizontal ropes.

14. The apparatus of claim 9 wherein said opening means comprises an opening in said horizontal ropes and said vertical ropes formed by spacing two of said horizontal ropes which are adjacent and two of said vertical ropes which are adjacent apart a distance sufficient to permit the user to enter said enclosure apparatus through said opening in said vertical and said horizontal ropes.

15. The apparatus of claim 9 wherein said panel assembly is U-shaped.

16. The apparatus of claim 9 wherein each of said vertical members are connected to one of said plurality of vertical legs.

17. The apparatus of claim 9 wherein said plurality of vertical ropes are spaced equidistantly apart.

18. The apparatus of claim 9 wherein said plurality of horizontal ropes are spaced equidistantly apart.

19. In a trampoline of the type having a plurality of spaced apart vertical legs supporting a horizontally disposed frame surrounding a bed, the improvement comprising an enclosure apparatus for preventing injury to a person using said trampoline, said enclosure apparatus comprising:

a. a plurality of U-shaped panel assemblies connected to said frame adjacent to each other completely around said frame, said panel assemblies extending upward from said frame, each of said panel assemblies including i. an elongated horizontal member having a first end and a second end, ii. two elongated vertical members having a top end and a bottom end, said top end of one on the two vertical members being connected to said first end of said elongated horizontal member and said top end of the other of said two vertical members being connected to said second end of said horizontal member, each of said vertical members being connected to one of said plurality of vertical legs, b. a plurality of parallel, equidistantly spaced vertical ropes connected to said elongated horizontal members and to said frame, c. a plurality of parallel, equidistantly spaced horizontal ropes connected to said elongated vertical members, and d. opening means in one of said panel assemblies for permitting a user of said trampoline to enter said enclosure apparatus, said opening means comprising an opening in said horizontal ropes and said vertical ropes formed by spacing two of said horizontal ropes which are adjacent and two of said vertical ropes which are adjacent apart a distance sufficient to permit the user to enter said enclosure apparatus through said opening in said vertical and said horizontal ropes.

20. The apparatus of claim 19 wherein said vertical members are connected to said vertical legs by clamp means for forcing said vertical members into parallel contact with said vertical legs.

21. The apparatus of claim 19 wherein each of said panel assemblies is connected to an adjacent panel assembly by said horizontal ropes.

* * * * *